US007484980B2

(12) United States Patent
Liao

(10) Patent No.: US 7,484,980 B2
(45) Date of Patent: Feb. 3, 2009

(54) LIGHTING TUBE ADAPTING DEVICE

(75) Inventor: Ming-Hong Liao, Taipei Hsien (TW)

(73) Assignee: Eiko (Pacific) Ltd., Port Louis (MU)

( * ) Notice: Subject to any disclaimer, the term of this patent is extended or adjusted under 35 U.S.C. 154(b) by 5 days.

(21) Appl. No.: 11/755,725

(22) Filed: May 30, 2007

(65) Prior Publication Data

US 2008/0031005 A1 Feb. 7, 2008

(30) Foreign Application Priority Data

Aug. 7, 2006 (TW) ..... 95213869 U

(51) Int. Cl.
*H01R 33/02* (2006.01)

(52) U.S. Cl. ..... 439/236

(58) Field of Classification Search ..... 439/236, 439/231, 242, 243, 232, 220
See application file for complete search history.

(56) References Cited

U.S. PATENT DOCUMENTS 5,138,245 A * 8/1992 Mattinger et al. ..... 320/115
5,904,415 A * 5/1999 Robertson et al. ..... 362/260
7,097,508 B1 * 8/2006 Yang ..... 439/617

* cited by examiner

*Primary Examiner*—Jean F Duverne
(74) *Attorney, Agent, or Firm*—Pai Patent & Trademark Law Firm; Chao-Chang David Pai

(57) ABSTRACT

A lighting tube adapting device includes an insulating base having two through holes for receiving two tube pins of a lighting tube, and an adapting unit including two adapting seats, two adapting members, and two bridge members. The adapting seats are spaced in the insulating base and define two hollow spaces separately communicating with the through holes on the insulating base. The adapting members are electrically conducting and mounted in the hollow spaces of the adapting seats, and respectively include a first sleeve portion for receiving one tube pin and a second sleeve portion sidewardly communicating with the first sleeve portion. The bridge members are electrically conducting, and respectively have a first adapting pin for inserting into the second sleeve portions and a second adapting pin for inserting into two pin insertion holes on a socket. Therefore, the lighting tube is electrically connected to the socket via the adapting device.

5 Claims, 5 Drawing Sheets

LIGHTING TUBE ADAPTING DEVICE

RELATED APPLICATION

This application claims priority to Taiwan Application Serial Number 95213869, filed Aug. 7, 2006, which is herein incorporated by reference.

FIELD OF THE INVENTION

The present invention relates to an adapting device, and more particularly, to a lighting tube adapting device.

BACKGROUND OF THE INVENTION

The conventional T8 fluorescent lighting tube having a diameter about 28 mm is large in volume to adversely occupy a relatively large space, and has low brightness, short service life, and high power consumption, compared to the newly developed T5 fluorescent lighting tube having a diameter about 16 mm, and is therefore gradually replaced by the improved T5 lighting tube.

Please refer to FIG. 1. The conventional T8 lighting tube 8 has a relatively large diameter, and a distance between two tube pins 81 spaced on each end of the lighting tube 8 is relatively large, accordingly. Herein, the distance between the two tube pins 81 is defined as the first distance D. Meanwhile, a socket 9 corresponding to the lighting tube 8 is provided with two pin insertion holes 91 for receiving the two tube pins 81. Therefore, a distance between the two pin insertion holes 91 must be the same as the first distance D.

However, the newly developed T5 fluorescent lighting tube has a relatively small diameter, and the distance between two tube pins spaced on each end thereof is relatively small, too. Herein, the distance between the two tube pins of the T5 lighting tube is defined as the second distance d, as shown in FIG. 4. The second distance d is obviously different from and smaller than the first distance D. Therefore, the T5 lighting tube and the socket 9 intended for the T8 lighting tube could not match each other. In other words, the existing T5 lighting tube could not be directly assembled to the socket 9 having a T8 specification. If it is desired to use the T5 lighting tube that provides improved lighting effect, the socket 9 must be changed to another socket having a T5 specification. For this purpose, a new mold must be made for producing the socket matching the T5 lighting tube. In addition, a steel holder 92 of the lighting tube for holding the socket 9 must also be changed at the same time. Such replacement involves in a lot of time, labor, and material to largely increase the cost for installing the T5 lighting tube.

It is therefore desirable to develop a simple way to electrically connect the T5 lighting tube with better lighting performance to the existing socket with T8 specification, so that the socket with T8 specification has widened applicability and the cost for installing new T5 lighting tubes can be reduced.

SUMMARY OF THE INVENTION

A primary object of the present invention is to provide a lighting tube adapting device that enables a lighting tube to electrically connect to a socket of different specification.

To achieve the above and other objects, the lighting tube adapting device according to the present invention is intended for mounting between a lighting tube and a socket having two different specifications. The lighting tube has two tube pins spaced on each end thereof, and the socket has two pin insertion holes spaced thereon.

And, the lighting tube adapting device of the present invention includes an insulating base and an adapting unit. The insulating base is provided near a rear side with two through holes, via which the two tube pins on one end of the lighting tube are extended into the insulating base. The adapting unit includes two adapting seats, two adapting members, and two bridge members.

The adapting seats are spaced in and near the rear side of the insulating base and respectively define a hollow space communicating with one of the two through holes on the insulating base.

The two adapting members are made of an electrically conducting material and separately mounted in the hollow spaces of the adapting seats. Each of the adapting members includes a first and a second sleeve portion sidewardly communicating with each other. The first sleeve portions are located corresponding to the through holes on the insulating base, so that the tube pins of the lighting tube are extended through the two through holes into the two first sleeve portions.

The bridge members are made of an electrically conducting material, and each has a first adapting pin for inserting into one of the two second sleeve portions on the adapting members, and an opposite second adapting pin for inserting into one of the two pin insertion holes on the socket. With these arrangements, the lighting tube and the socket having different specifications can be electrically connected to each other via the adapting device.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 4:
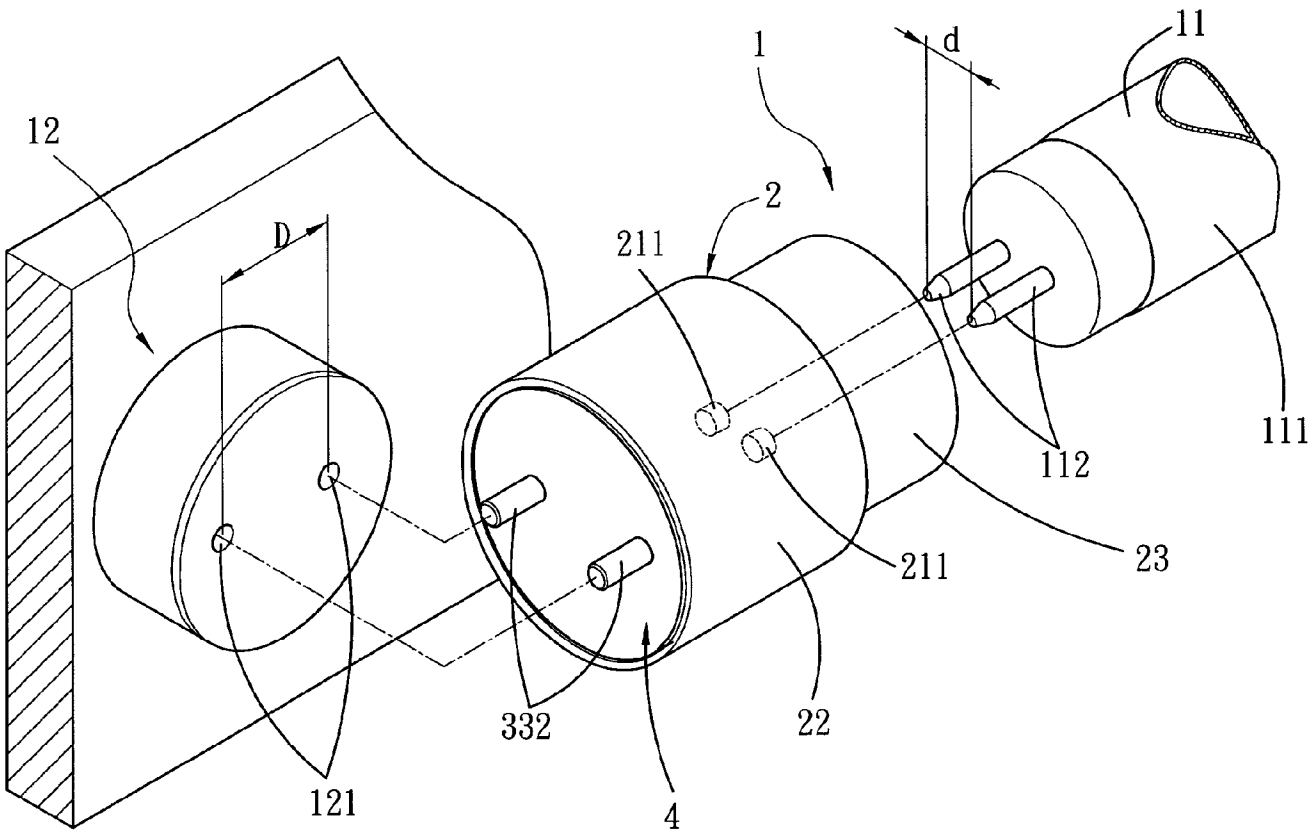
FIG. 4 is an exploded perspective view showing the connection of the lighting tube adapting device of FIG. 2 to and between a T5 lighting tube and a T8 lighting tube socket.

Please refer to FIG. 4 that shows how a lighting tube adapting device 1 according to a preferred embodiment of the present invention is connected to and between a lighting tube 11 and a socket 12, so that the lighting tube 11 and the socket 12 having different electric specifications can be electrically connected to each other. In the illustrated preferred embodiment, the lighting tube 11 is a T5 fluorescent lighting tube, and the socket 12 is a socket intended for a T8 fluorescent lighting tube.

The lighting tube 11 includes a tube body 111, and two tube pins 112 spaced on each of two opposite ends of the tube body 111 to define a second distance d between them. The socket 12 includes two spaced pin insertion holes 121 defining a first distance D between them.

Figure 1:
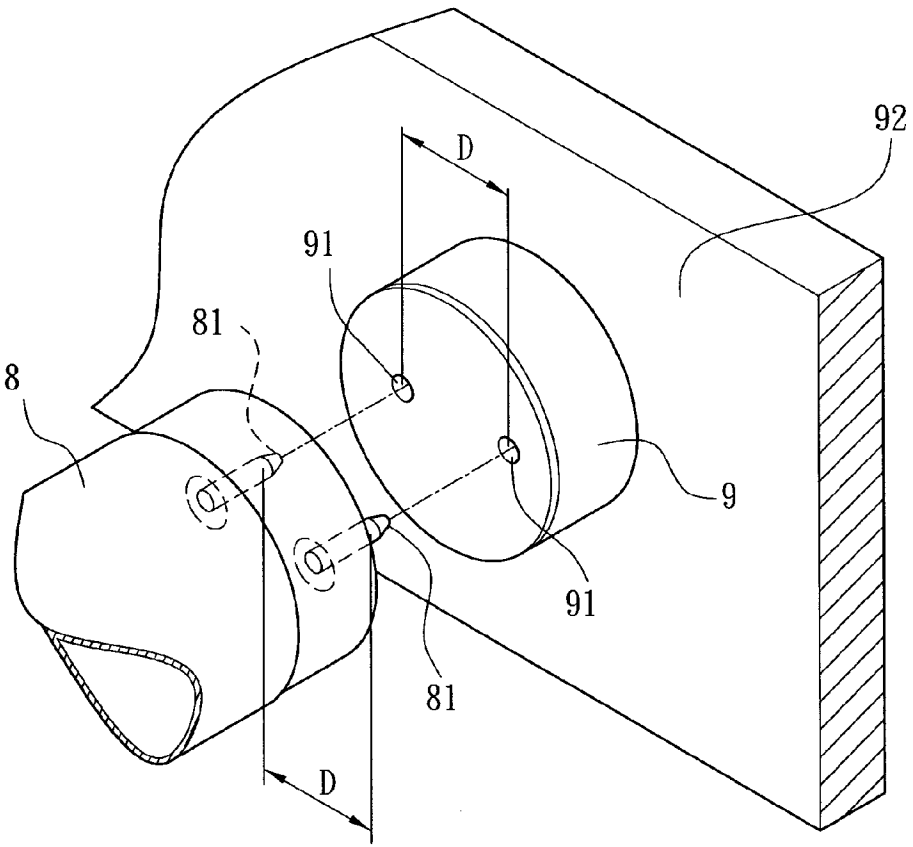
Fig. 1 (PRIOR ART)
FIG. 1 is a fragmentary exploded perspective view showing a conventional T8 lighting tube and a mating socket thereof.
Figure 2:
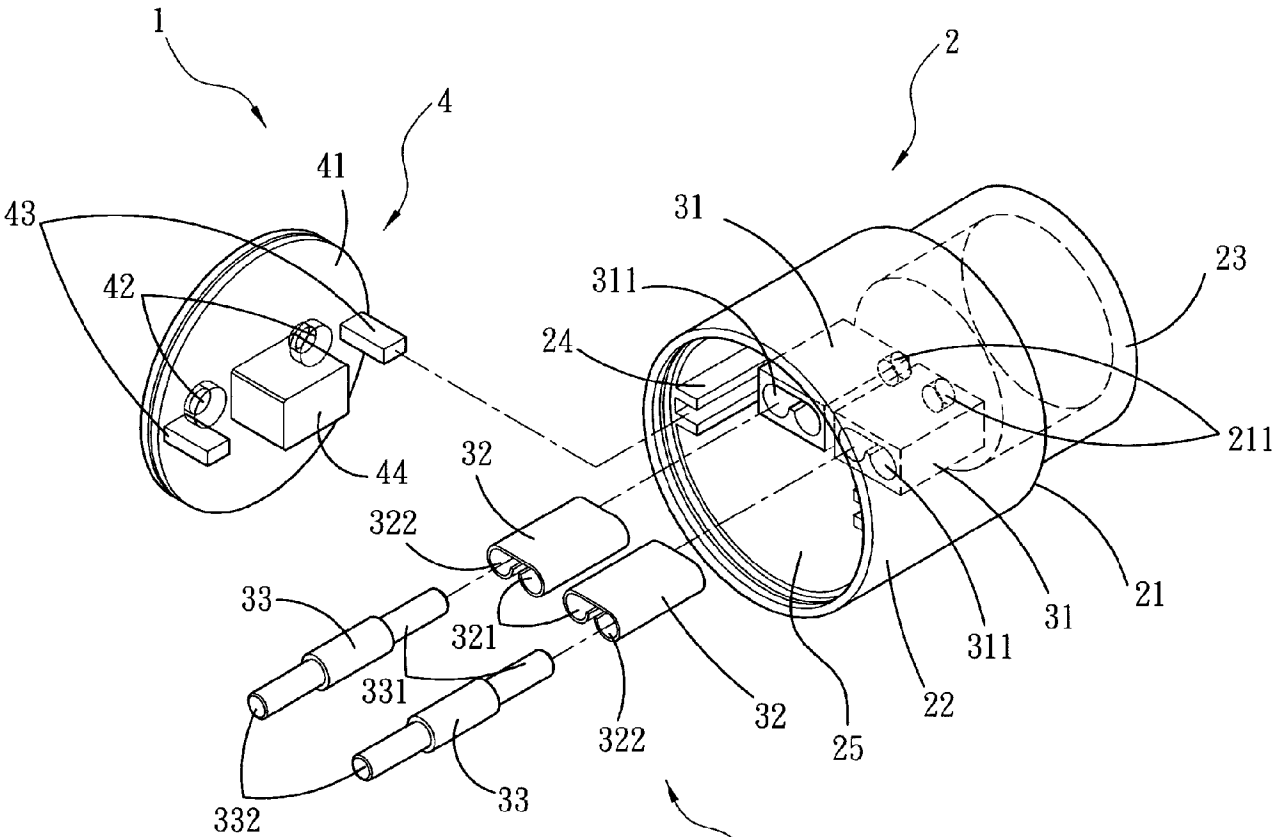
FIG. 2 is an exploded perspective view of a lighting tube adapting device according to a preferred embodiment of the present invention.
Figure 3:
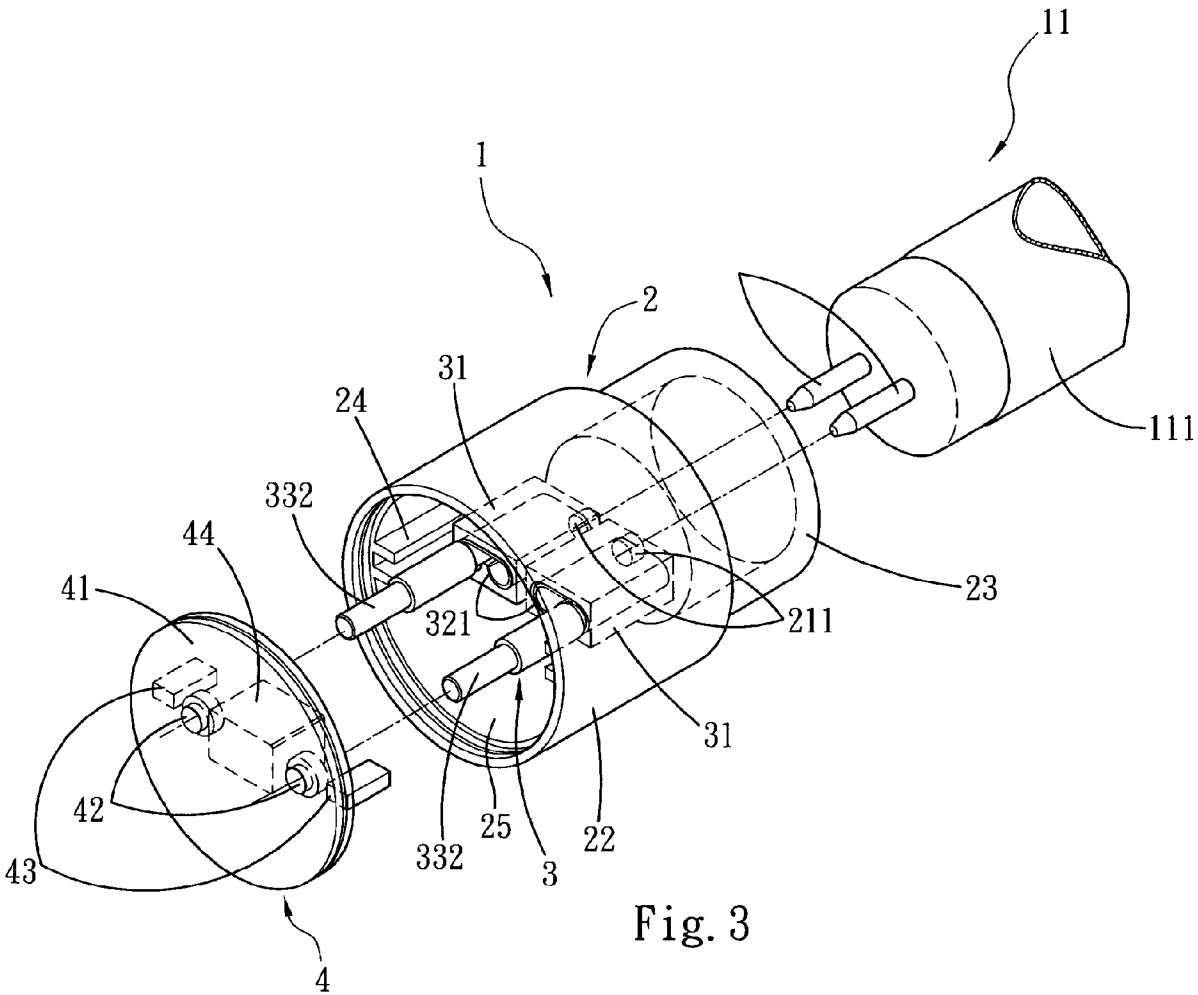
FIG. 3 is a partially exploded perspective view showing the assembling of the lighting tube adapting device of FIG. 2 to a T5 lighting tube.
Figure 5:
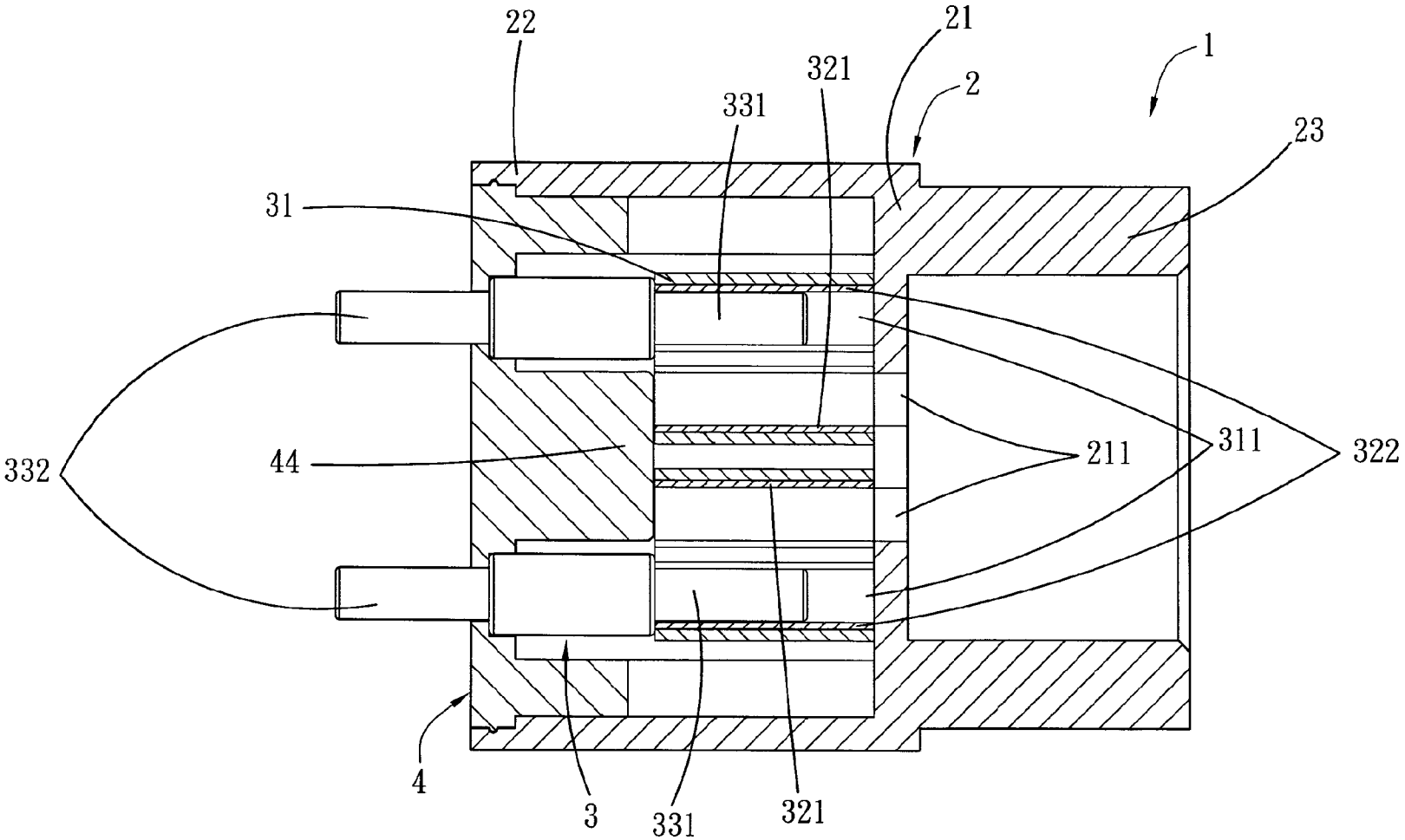
FIG. 5 is an assembled sectioned side view of the lighting tube adapting device of FIG. 2.

Please refer to FIGS. 2, 3, and 5 at the same time. The lighting tube adapting device 1 includes an insulating base 2, an adapting unit 3, and an insulating seal cap 4.

In the illustrated embodiment, the insulating base 2 is made of a plastic material, and includes a partition wall 21, a first peripheral wall 22 forward extended from a periphery of the partition wall 21, and a second peripheral wall 23 rearward extended from the periphery of the partition wall 21 for an end of the tube body 111 of the lighting tube 11 to extend thereinto. The partition wall 21 is provided with two axially extended through holes 211, through which the two tube pins 112 on the end of the tube body 111 are extended. That is, a distance between the two through holes 211 is the same as the second distance d between the two tube pins 112.

The adapting unit 3 includes two adapting seats 31, two adapting members 32, and two bridge members 33.

The two adapting seats 31 are integrally formed on and forward projected from the partition wall 21, and respectively have an axially extended hollow space 311 separately communicating with one of the two through holes 211 on the partition wall 21 and in the shape corresponding to that of the adapting members 32.

In the illustrated embodiment, the adapting members 32 are formed by stamping an electrically conducting spring plate. The two adapting members 32 are separately mounted in the hollow spaces 311 of the two adapting seats 31, and respectively include a first sleeve portion 321 and a second sleeve portion 322, which are arranged side by side and communicable with one another. Wherein, the first sleeve portions 321 are located at inner sides of the two adapting members 32 corresponding to the two through holes 211 on the partition wall 21, so that a distance between the two first sleeve portions 321 is the same as the second distance d between the two tube pins 112. The two first sleeve portions 321 also have a bore corresponding to a diameter of the two tube pins 112 of the lighting tube 11, so as to receive the tube pins 112 therein. On the other hand, the second sleeve portions 322 are located at outer sides of the two adapting members 32 with a distance between them the same as the first distance D between the two pin insertion holes 121 on the socket 12.

The bridge members 33 are made of an electrically conducting material, and each includes two axially opposite pins, namely, a rear first adapting pin 331 and a front second adapting pin 332. The first adapting pins 331 have a diameter corresponding to a bore of the second sleeve portions 322, so as to be inserted in the second sleeve portions 322 located at outer sides of the two adapting members 32. The second adapting pins 332 have a diameter corresponding to a bore of the pin insertion holes 121 on the socket 12, so as to be inserted into the pin insertion holes 121.

The insulating seal cap 4 is made of a plastic material for sealing an opening 25 at a front end of the first peripheral wall 22 of the insulating base 2. The insulating seal cap 4 includes a cap body 41 sealing the opening 25 at the front end of the first peripheral wall 22, and two through holes 42 spaced on and axially extended through the cap body 41 to correspond to the second sleeve portions 322 at outer sides of the two adapting members 32. That is, a distance between the two through holes 42 is the same as the first distance D between the two pin insertion holes 121 on the socket 12, so that the second adapting pins 332 are allowed to extend through the through holes 42 into the pin insertion holes 121.

In the illustrated embodiment, the insulating seal cap 4 and the insulating base 2 are detachably assembled by way of slide fit. More specifically, the insulating seal cap 4 further includes two rail portions 43 spaced on and axially extended from a rear side of the cap body 41, and the insulating base 2 is correspondingly provided with two guide ways 24 on an inner surface of the first peripheral wall 22, so that the rail portions 43 are slidable in the corresponding guide ways 24. In this manner, the insulating seal cap 4 is detachably mounted to the front end of the insulating base 2.

To prevent the adapting members 32 from axially displacing in the adapting seats 31, the insulating seal cap 4 further includes a limiting post 44 rearward extended from the rear side of the cap body 41 for correspondingly bearing against a front side of the adapting seats 31, and accordingly, the first sleeve portions 321 at the inner sides of the two adapting members 32.

To assemble the adapting device 1 of the present invention to the lighting tube 11 and the socket 12, first position the two adapting members 32 in the hollow spaces 311 of the two adapting seats 31, and extend the first adapting pins 331 of the two bridge members 33 into the second sleeve portions 322 at the outer sides of the two adapting members 32. Then, slide the rail portions 43 on the insulating seal cap 4 into the guide ways 24 in the insulating base 2, so that the cap body 41 closes the front opening 25 of the insulating base 2. Thereafter, forward extend the second adapting pins 332 of the two bridge members 33 through the through holes 42 on the insulating seal cap 4. At this point, the limiting post 44 is pressed against the front side of the adapting seats 31 to restrict the adapting members 32 from displacing.

To use the adapting device 1, simply insert the tube body 111 of the lighting tube 11 into the second peripheral wall 23 of the insulating base 2, so that the tube pins 112 of the lighting tube 11 are extended through the through holes 211 on the partition wall 21 of the insulating base 2 into the first sleeve portions 321 of the adapting members 32. Then, insert the second adapting pins 332 of the two bridge members 33 into the pin insertion holes 121 on the socket 12. With the electrically conducting adapting members 32 and bridge members 33 functioning like a bridge, the socket 12 and the lighting tube 11 having different specifications are electrically connected to one another via the lighting tube adapting device 1 of the present invention. Therefore, the adapting device 1 provides very good applicability.

It is noted, in practical implementation, the bores and distances for the sleeve portions 321, 322 of the adapting members 32, as well as the diameters for the adapting pins 331, 332 of the bridge members 33 may be varied according to the specifications of the lighting tube 11 and the socket 12, such as the bore of and the distance between the tube pins 112 and the pin insertion holes 121. The adapting device 1 is therefore highly flexible in the design thereof.

In conclusion, the lighting tube adapting device 1 of the present invention utilizes the adapting unit 3 along with the insulating base 2 and the insulating seal cap 4 to allow lighting tube 11 and socket 12 of different specifications to electrically connect to one another, giving the lighting tube 11 and the socket 12 widened applications.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A lighting tube adapting device for mounting between a lighting tube and a socket, the lighting tube having two tube pins spaced on each end thereof, and the socket being provided with two spaced pin insertion holes; the adapting device comprising:

an insulating base provided with two spaced through holes, through which the two tube pins of the lighting tube may be extended; and an adapting unit including:

two adapting seats located on a rear side in the insulating base and spaced side by side, each of the adapting seats having an axially extended hollow space communicating with one of the two through holes on the insulating base;

two adapting members made of an electrically conducting material and separately mounted in the hollow spaces of the two adapting seats; each of the adapting members having a first sleeve portion at an inner side relative to the insulating base and a second sleeve portion at an outer side relative to the insulating base that are arranged side by side and communicable with each other; and the first sleeve portions being located corresponding to the two through holes on the insulating base for receiving the tube pins of the lighting tube therein; and two bridge members made of an electrically conducting material, and each of the bridge members having a first adapting pin for inserting into one of the two second sleeve portions, and a second adapting pin opposite to the first adapting pin for inserting into one of the two pin insertion holes on the socket;

whereby the lighting tube and the socket are electrically connected to each other via the lighting tube adapting device.

2. The lighting tube adapting device as claimed in claim 1, wherein the insulating base includes a partition wall, a first peripheral wall forward extended from a periphery of the partition wall, and a second peripheral wall rearward extended from the periphery of the partition wall for receiving an end of the lighting tube therein; and wherein the through holes on the insulating base are located on the partition wall.

3. The lighting tube adapting device as claimed in claim 2, further comprising an insulating seal cap for sealing an opening of the insulating base defined at a front end of the first peripheral wall; the insulating seal cap including a cap body for connecting to and sealing the front opening of the first peripheral wall, and two through holes spaced on the cap body corresponding to the second sleeve portions of the adapting members, so that the second adapting pins of the bridge members are forward extended through the two through holes on the cap body into the pin insertion holes on the socket.

4. The lighting tube adapting device as claimed in claim 3, wherein the insulating seal cap further includes two rail portions spaced on and extended from one side of the cap body closer to the insulating base; and the insulating base further includes two opposite guide ways formed on an inner surface of the first peripheral wall corresponding to the two rail portions on the cap body; the rail portions being slidable mounted in the guide ways, allowing the insulating seal cap to be detachably connected to the insulating base.

5. The lighting tube adapting device as claimed in claim 3, wherein the insulating seal cap further includes a limiting post extended from the side of the cap body closer to the insulating base to bear against the adapting seats and accordingly the first sleeve portions of the adapting members, preventing the adapting members from displacing axially.

* * * * *